US005103146A

United States Patent [19]

Hoffman

[11] Patent Number: 5,103,146

[45] Date of Patent: Apr. 7, 1992

[54] CONTROL FOR A REMOTE, RADIO OPERATED DEVICE

[76] Inventor: Ronald J. Hoffman, 33165 Cannon Rd., Solon, Ohio 44139

[21] Appl. No.: 653,350

[22] Filed: Feb. 11, 1991

[51] Int. Cl.[5] ..... H04B 7/00

[52] U.S. Cl. ..... 318/16; 340/825.69

[58] Field of Search ..... 318/16; 340/825.57, 340/825.69, 825.72

[56] References Cited

U.S. PATENT DOCUMENTS

| | | | |
|---|---|---|---|
| 3,832,691 | 8/1974 | Galler | 340/171 R |
| 4,143,307 | 3/1979 | Hansen et al. | 318/16 |
| 4,160,253 | 7/1979 | Mabuchi et al. | 343/225 |
| 4,168,468 | 9/1979 | Mabuchi et al. | 325/37 |
| 4,390,877 | 6/1983 | Curran | 340/825.72 |
| 4,424,470 | 1/1984 | Finch | 318/16 |
| 4,584,504 | 4/1986 | Lee et al. | 318/16 |
| 4,935,736 | 6/1990 | Meierdierck | 340/825.69 |
| 4,964,331 | 10/1990 | Halevy et al. | 89/37.19 |

*Primary Examiner*—Bentsu Ro

[57] ABSTRACT

A system for controlling the electric motor in a remote, radio controlled device includes a regulator controller which supplies energy from a battery to a receiver at a regulated level, decodes the channel output from the receiver to switch power from the battery to the motor when proper signals come from the receiver, and if the battery voltage goes low it cuts off the motor and keeps it off until the battery voltage rises above a threshold level and a manual reset enable device is actuated.

3 Claims, 3 Drawing Sheets

CONTROL FOR A REMOTE, RADIO OPERATED DEVICE

BACKGROUND OF THE INVENTION

1. Field of the Invention

This invention relates to a device for providing complete control of an electric motor in a remote, radio controlled moving device, such as a model airplane.

2. Description of the Related Art

With the advent of Ni-Cad batteries, model airplane builders found that they could use electric permanent magnet motors to power their aircraft instead of using conventional two-stroke gas engines. The gas engines provided ample power and thrust so that the weight of the remote control receiver, the receiver batteries, the servo controllers and various linkages did not pose a weight problem for flying the plane. Electric motors do not deliver as much thrust, and they require batteries. This combination makes saving weight in the aircraft an imperative goal if a reasonable flight envelope for the aircraft is to be achieved. If the receiver batteries, ON/-OFF switch wiring harness, servo and micro-switch can be eliminated, significant weight savings can be realized which will lengthen flying time; increase the rate of climb; enable aerobatic maneuvers; extend the glide ratio and generally improve the flying performance of the plane.

SUMMARY OF THE INVENTION

It is an aspect of the present invention to control the motor in a remote, radio operated device.

It is an object of the invention to reduce the weight of an electrically driven remote, radio controlled airplane.

A more particular object is to eliminate the receiver batteries and the servo-controlled motor switch in remote, radio controlled airplane driven by an electric motor.

It is a specific object of the invention to provide a voltage regulating means for a remote control receiver with the necessary voltage and current to eliminate the receiver batteries.

An aspect of the invention is to protect a remote, radio controlled airplane, from damage if its control circuit becomes non-operational.

It is another aspect of the invention to provide a power switching means for operatively controlling the ON/OFF condition of a electric propeller motor for a remote, radio controlled airplane.

Yet a further aspect of the invention is to provide a remote, radio controlled airplane which turns the electric motor OFF if the receiver malfunctions.

It is an aspect of the invention to provide a signal decoding means to activate the power switching means according to the pulse width of the signal at the receiver channel output.

It is an aspect of the invention to provide a missing pulse detector means to deactivate the signal decoding means and deactivate the power switching means whenever there is an absence of signal pulses from the receiver channel output.

It is still another object of the invention to provide a remote, radio controlled airplane which turns the electric motor OFF if the plane flies beyond its control range.

It is another aspect of the invention to prevent the airplane from flying until components are made operational.

Another particular object of the invention is to lock OFF the motor of a remote, radio controlled airplane when initial power is applied to the airplane until the user presses an enable push-button switch.

A specific aspect of the invention is to provide a low battery detection and lock-out means to de-activate the signal decoding means and de-activate the power switching means of a remote, radio-controlled airplane whenever the battery voltage goes below a preset reference voltage and to lock-out said means until the voltage is above said reference voltage level and the manual reset button means is pressed.

It is also an object of the present invention to shut and lock OFF the electric motor of a remote, radio controlled airplane when the motor battery voltage goes below a predetermined threshold voltage, and if the plane is in the air to provide for the receiver and servo control to enable a safe, controlled landing of the airplane.

It is a specific aspect of the invention to provide for a remote, radio controlled airplane a power-up lock-out means to de-activate the signal switching means and the power switching means when power is initially applied to the control module.

It is in general an object of the present invention to provide an efficient and economical remote, radio controlled airplane or other movable radio controlled device which is easy to assemble and operate, and protects the operation and durability of the device.

BRIEF DESCRIPTION OF THE DRAWINGS

The invention can be better understood after reference has been made to the accompanying drawings.

DETAILED DESCRIPTION OF THE PREFERRED EMBODIMENT

Figure 1:
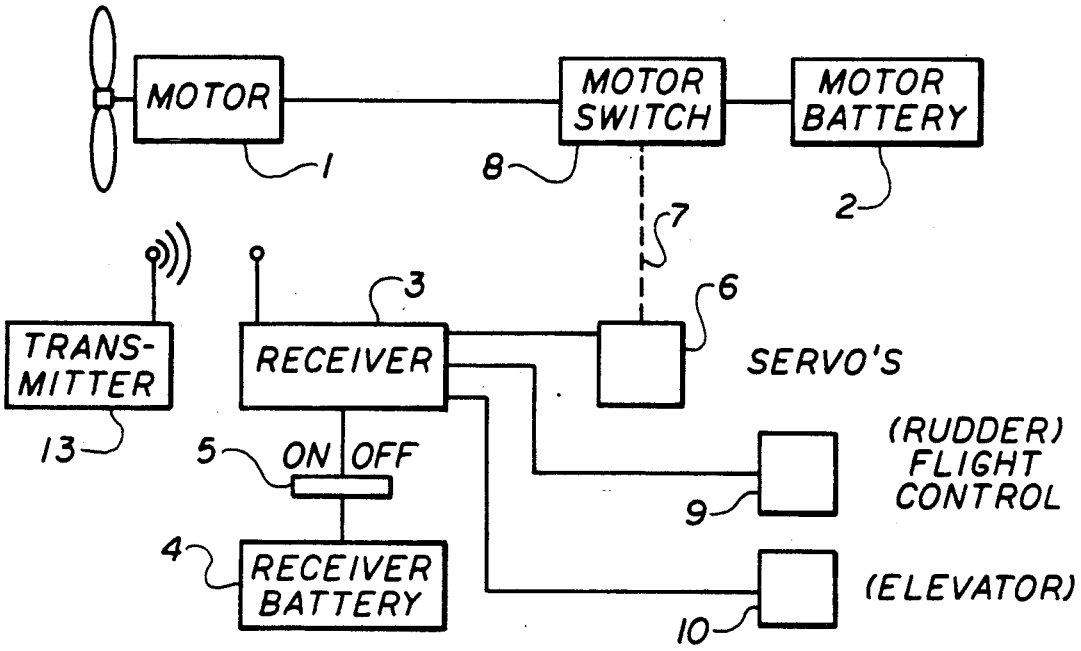
FIG. 1 is a system control block diagram showing the previous method of controlling the propeller motor and powering the remote control receiver.
Figure 2:
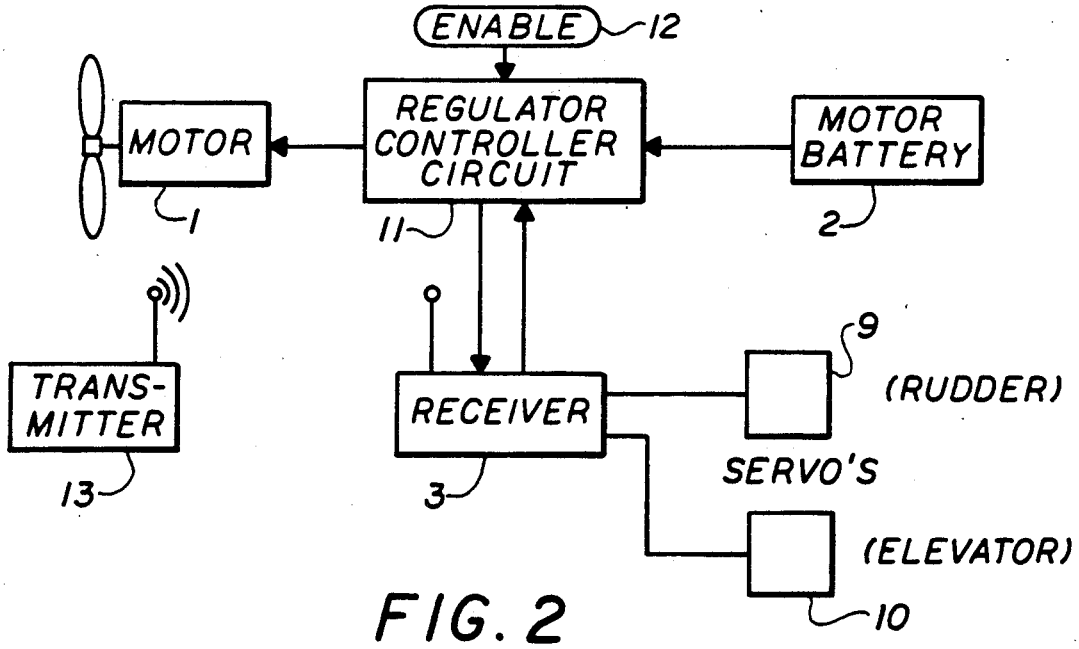
FIG. 2 is a system control block diagram showing the improved method of controlling the propeller motor and powering the remote control receiver.

A brief comparison between FIG. 1 and FIG. 2 will help to identify in a general nature the component blocks of the system. Like items have the same numeric reference in each figure. An electric motor 1 is connected to a battery pack 2 for driving the motor. A receiver 3 receives radio signals from a remote transmitter 13, and it controls motor 1 and flight control mechanisms 9, 10 for operating the rudder and elevator, etc. of the airplane. In the prior art as shown in FIG. 1, receiver 3 has its own battery pack 4 to which it is connected by a wiring harness including external ON/OFF switch 5. The prior art system also includes a micro switch 8 for turning the motor on or off, and a servo control unit 6 which is operated by receiver 3 and operatively connected to switch 8 by a linkage 7. The receiver battery pack 4, the wiring harness, the servo 6, linkage 7 and micro switch 8 generally weigh from 6 to 9 ounces.

In the embodiment of the invention shown in FIG. 2, the motor control requires only a regulator controller circuit 11 and a reset such as an circuit enable push-button 12 which together weight about 0.6 ounces. Regulator controller circuit 11 decodes the channel signal from receiver 3, and switches propeller motor 1 ON and OFF, supplies receiver 3 with regulated 5 volts from motor battery pack 2, provides "no signal" motor shut-off, low battery voltage motor shut-off and low voltage and power-up motor lock-out signals, all as discussed below.

Figure 3:
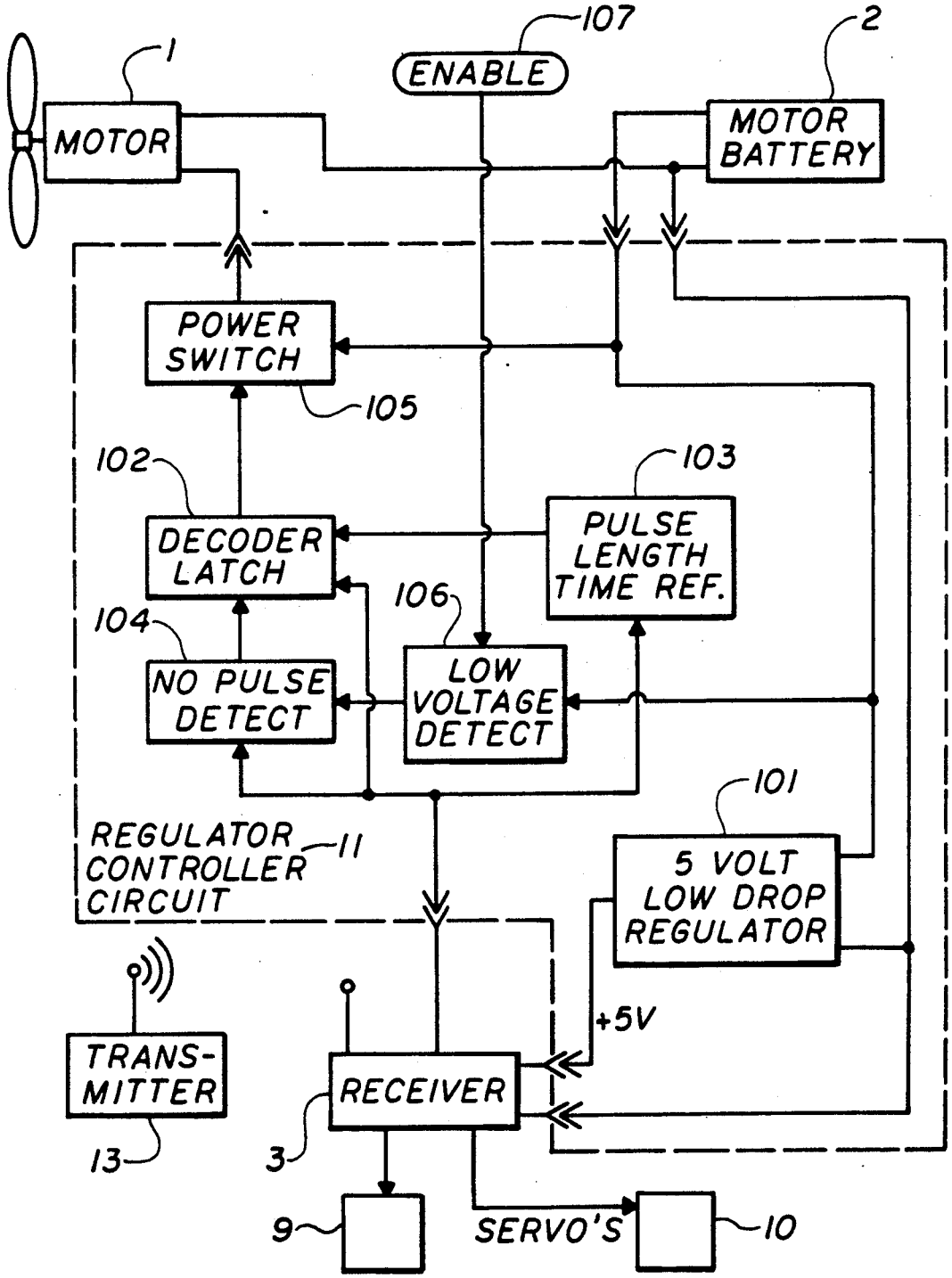
FIG. 3 is a detailed system block diagram showing the detail circuit functions for controlling the propeller motor and powering the remote control receiver.
Figure 4:
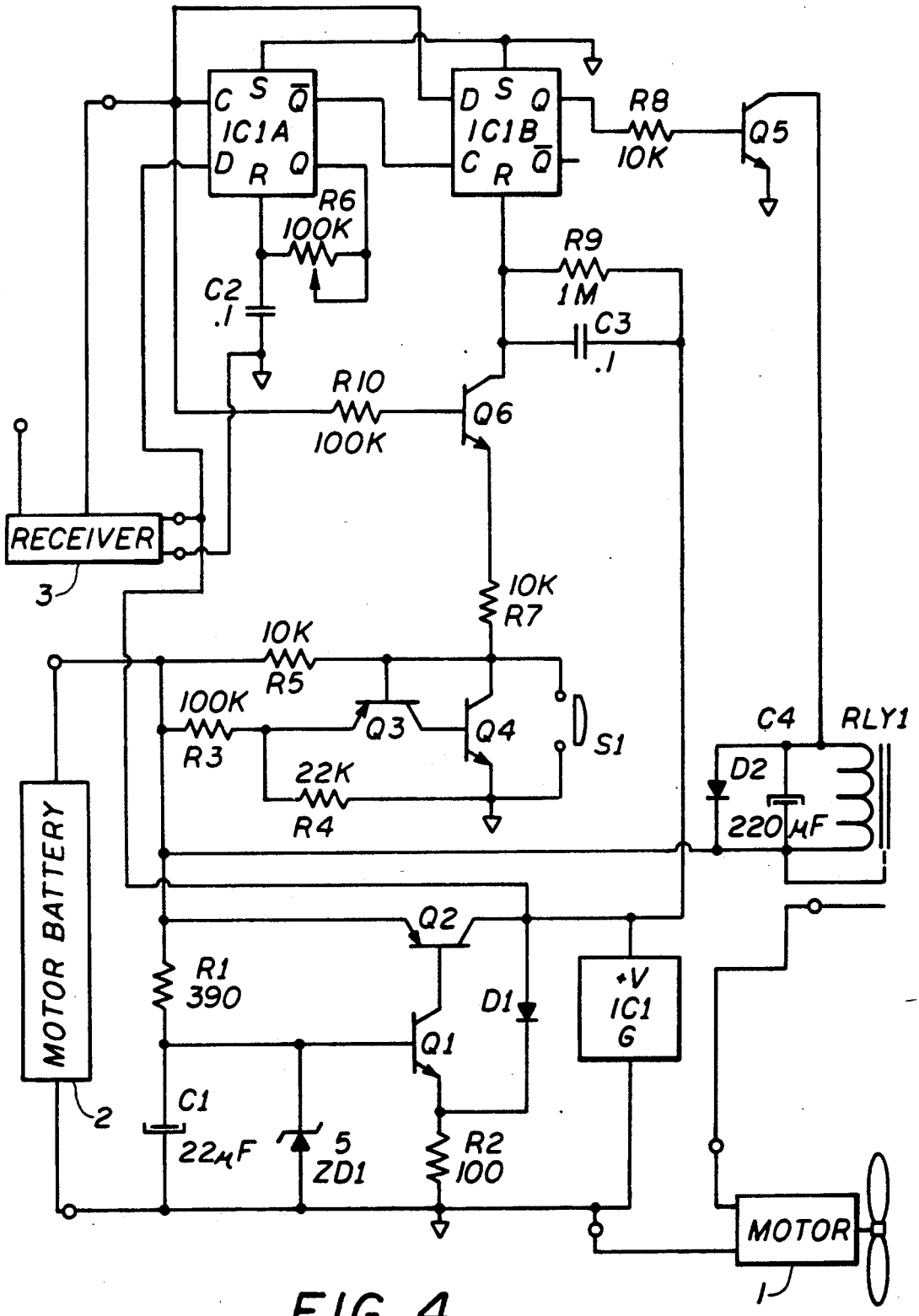
FIG. 4 is a schematic circuit diagram of the control module and shows connections to the related system blocks, i.e., receiver, propeller motor and batteries.

Referring to FIGS. 3 and 4, propeller motor 1, in the preferred form of the invention, is driven by 8.4 volts which is supplied by motor battery pack 2. Receiver 3 in the prior art was powered by a separate, four cell 4.8 volt battery pack 4. To eliminate the receiver battery pack, regulator controller circuit 11 contains a low-drop, 5 volt regulator 101. 8.4 volts from the motor battery pack 2 is supplied to the input of regulator 101 and the 5 volt output of regulator 101 supplies the required voltage to receiver 3 and to servo controllers 9 and 10. The low-drop feature allows the regulated voltage, 5 volts, to remain constant as long as possible while the motor battery pack 2 voltage is dropping during the flight.

Referring to the circuit diagram of FIG. 4, low-drop, 5 volt regulator 101 includes resistors R1, R2, capacitor C1, zener diode ZD1, and transistors Q1, Q2. Resistor R1, capacitor C1 and zener diode ZD1 form a voltage reference for transistor Q1. Diode D1 and resistor R2 provide negative feedback to the emitter of transistor Q1. If the output voltage is less than the reference voltage, then Q1 will conduct which turns ON transistor Q2 and raises the output voltage until it is equal to the reference voltage. If the output voltage is greater than the reference voltage, Q1 turns OFF which turns OFF Q2 and reduces the output voltage until it is equal to the reference voltage. The minimum voltage drop across Q2 is about 0.4 volts which means that regulation can be maintained as long as the input voltage is 0.4 volts higher than the reference voltage across zener diode ZD1, or about 5.5 volts. Diode D1 in the feedback circuit provides a matching voltage drop equal to the base-emitter voltage drop of transistor Q1, so that the output voltage is equal to the reference voltage at ZD1. The 5 volt output at the collector of Q2 supplies the operating voltage to decoder 102 and to the receiver 3 and servo controllers 9 and 10. In the circuit shown in FIG. 4, resistor R1 is 390 ohms, capacitor C1 is 22 microfarads, zener diode ZD1 is an IN4722 unit of 5.1 volts, transistor Q1 is a 2N 3904 unit and resistor R2 is a 100 ohm unit.

Receiver 3 may have several output channels to control different parts of the plane such as elevator, rudder, landing gear, ailerons and so on. Each channel puts out a continuous stream of pulses whose pulse length may vary from 1 to 2 milli-seconds and whose rate is about 50 pulses per second.

To control electric propeller motor 1, a decoder 102 is needed to evaluate the channel pulse width and provide an output. If the pulse width is less than reference time 103, then the output from decoder latch 102 is a logical 0 (OFF). If the pulse width is greater than reference time 103, then the output from decoder 102 is a logical 1 (ON). As shown in FIG. 4, pulse length time reference 103 is comprised of flip-flop IC1A, resistor control R6, and capacitor C2 which form a one-shot pulse generator. Decoder latch 102 is comprised of flip-flop IC1B. When the clock input of IC1A makes a low-to-high transition, the high data is clocked to the Q output. Capacitor C2 begins to charge through resistor R6. When the reset voltage threshold is reached, flip-flop IC1A is reset and the Q output returns to zero and resistors R6 discharges capacitor C2. The Q bar output is just the opposite and so it is high until the rising edge of the clock pulse is seen. Q bar goes low for the set reference period of time determined by the adjustment of resistor R6 and then returns high. So for each rising clock edge, a low-then-high pulse is generated at the Q bar output of IC1A, whose length is set by the adjustment of resistor R6. This fixed pulse is the pulse width time reference 103. A flip flop IC1B compares the level of the channel input signal with pulse width time reference 103. If the input pulse width is longer than the reference pulse width, then flip flop IC1B will clock in a data high (logical 1 or ON) at output Q. If the input pulse width is shorter than the reference pulse width, then flip flop IC1B will clock in a data low (logical 0 or OFF) at output Q.

A power switch 105 is connected to the output of decoder 102 and battery 2. In its preferred embodiment, flip flops IC1A and IC1B are a 4013 units, variable resistor R6 can be set for 100K ohms and capacitor C2 is 0.1 farad. Power switch 105 is formed by resistor R8, transistor Q5, capacitor C4, diode D2 and relay RLY1. When the Q output of IC1B is high, transistor Q5 is turned ON via resistor R8. This energizes relay RLY1. Capacitor C4 eliminates any noise or relay chatter as relay RLY1 is being energized. When the Q output of IC1B goes low, transistor Q5 turns OFF and relay RLY1 is de-energized. Diode D2 is a flyback diode which protects transistor Q5 and capacitor C4 from voltage transients. On the preferred embodiment, resistor R8 has 10K ohms, transistor Q5 is a 2N2222A unit, capacitor C4 has 220 micro farads, and RLY1 is a OJE-SS-109HM unit.

A missing pulse detector 104 is connected to the output of low voltage detector 106 and receiver 3, and has its output connected to decoder 102. Detector 104 is formed by resistors R9, R10, transistor Q6 and capacitor C3. When pulses are detected at the signal input from the receiver 3, transistor Q6 is turned ON via resistor R10, and capacitor C3 is charged. The voltage at the junction of flip flop IC1B reset input, resistor R9, capacitor C3 and transistor collector Q6 goes low. This allows flip flop IC1B to decode pulse information and control the propeller motor 1. If the receiver 3 looses the transmitter signal (bad transmitter batteries or the receiver is out of range of the transmitter), or if the receiver channel connector were loose, the loss of pulses at the signal input would cause transistor Q6 to remain OFF. Resistor R9 would discharge capacitor C3 until the reset input of IC1B goes high. This resets IC1B, turns OFF power switch 105 and in turn, shuts OFF propeller motor 1. When initial power is applied, capacitor C3 resets flip flop IC1B which assures an initial propeller motor OFF condition. In its preferred form, missing pulse detector 104 is comprised of R9 of 1M ohm, R10 of 100K ohms, transistor Q6 which is a 2N3904 unit, and a 0.1 micro-farad (uf) capacitor C3.

The low voltage detector 106 is connected to battery 2 and has its output connected to no pulse detector 104. It is comprised of resistors R3, R4, R5, R7 and transistors Q3, Q4. Detector 106 is connected to reset enable 107. Reset enable 107 is a normally open momentary, push-button switch, S1, which enables the low voltage detector to be reset when enable 107, is pressed. Transistors Q3, Q4 form a latch type bi-stable condition circuit. If the input voltage is less than 4.3 volts (in the preferred circuit), the emitter voltage of transistor Q3 will be less than 0.78 volts. The saturation voltage of transistor Q4 is about 0.4 volts and the minimum forward bias for transistor Q3 (base to emitter) is about 0.4 volts. When the voltage goes below this value, then transistor Q3 turns OFF and transistor Q4 turns OFF. The base voltage of transistor Q3 goes to + Vin and transistors Q3 and Q4 remain OFF regardless of the increase in + Vin. When initial power is applied to the circuit, transistors Q3, Q4 remain OFF. This provides the power-up lock-out feature since capacitor C3 cannot discharge through transistor Q6 and resistor R7. If the system voltage is greater than 4.3 volts and the reset enable 107 is pressed, transistor Q3 and Q4 turn ON. When reset enable 107 is released, transistor Q4 remains ON in a saturated state and transistor Q4's collector voltage cannot rise above 0.4 volts. The base of transistor Q3 is connected to transistor Q4's collector. Transistor Q3's emitter voltage is higher than its base voltage and is biased ON. When transistors Q3 and Q4 are biased ON, they are latched and cannot be turned OFF until the supply voltage is interrupted or falls below the critical latch threshold level (4.3 volts). The latch threshold value can be changed by adjusting the values of the divider resistors R3 and R4.

The invention has been disclosed in detail, with particular emphasis being placed on the particular mode of the invention. However, variations and modifications within the spirit and scope of the invention may occur to more skilled in the art which the invention pertains.

Having described the invention, the following is claimed:

1. A system for controlling an electric motor in a remote, radio controlled movable device, said system comprising:

battery means for supplying electric power to the electric motor and to said system;

electrical connections extending to the motor and to other electrically controlled parts of the device;

receiver means for receiving radio signals from a radio transmitter for generating signals of pulse widths over said electrical connections for turning the motor ON or OFF and for controlling the other electrically operated parts of the device; and regulator controller means for decoding the pulse widths of said signals from said receiver means over said electrical connections and for supplying preset voltage from said battery means to said receiver means; said regulator controller means including:

voltage regulator means for receiving current from said battery means and for supplying current at a predetermined voltage to said receiver means when the voltage of said battery means has enough strength, and for regulating said system to enable said battery means to supply current at said predetermined voltage to said receiver means when said battery means falls below the required strength;

pulse width decoder means for evaluating the pulse width of the signals of the receiver means according to a preselected referenced period of time; and power switch means connected to said pulse width decoder means, said battery means and the motor;

said pulse width decoder means generating a motor-on signal to said power switch means when the pulse width is greater than the preselected reference time period and said power switch means turning on said motor in response to said motor-on signal;

said pulse width decoder means generating a motor-off signal to said power switch means when the pulse width from said receiver means is less than the preselected reference time period, and said power switch means turning off said motor in response to said motor off-signal.

2. A system according to claim 1, and further including no-pulse detector means connected to said receiver means and to said pulse width decoder means, said no-pulse detector means generating a no-pulse signal to said pulse width decoder means when said receiver means fails to generate pulses over a period of time, and said pulse width decoder means generating said motor-off signal in response to said no-pulse signal.

3. A system according to claim 2 and further including a low voltage detector means connected to said battery means and to said no-pulse detector means, said low voltage detector means disabling said no-pulse detector means when the system voltage is below a preselected voltage; said low voltage detector means having a reset enable means manually actuable to reset said low voltage detector means;

said low voltage detector means being further operatively connected to said no-pulse detector means and to said pulse width decoder means for disabling said pulse width decoder means when the system voltage is below said preselected voltage, and enabling said pulse width decoder means when the system voltage thereafter goes above said preselected voltage and said reset enable means is manually actuated to reset said low voltage detector means.

* * * * *